US005228160A

United States Patent [19]

Porper

[11] Patent Number: 5,228,160

[45] Date of Patent: Jul. 20, 1993

[54] CUE TIP SHAPING TOOL AND FILE FABRICATION METHOD FOR USE THEREWITH

[76] Inventor: Joseph Porper, 7741 Alabama Ave. #11, Canoga Park, Calif. 91303

[21] Appl. No.: 864,041

[22] Filed: Apr. 6, 1992

[51] Int. Cl.[5] ..... B26B 11/00

[52] U.S. Cl. ..... 7/158; 7/163; 51/181 R; 51/211 R; 30/494

[58] Field of Search ..... 7/124, 158, 163; 30/494; 51/181 R, 204, 205 R, 211 R

[56] References Cited

U.S. PATENT DOCUMENTS 4,471,824 9/1984 Zownir ..... 51/205 R X 4,620,370 11/1986 Zownir et al. ..... 30/494

4,785,586 11/1988 Kratfel ..... 30/494 X

*Primary Examiner*—James G. Smith

*Attorney, Agent, or Firm*—Gilbert Kivenson

[57] ABSTRACT

A multipurpose cue tip preparation tool containing a number of openings for the insertion of a pool cue end. Access is provided for cleaning and flattening the ferrule end of a cue stick prior to the cementing on of a new tip. After the cement has dried, the invention may be used for trimming the excess tip material, rounding the playing end, comparing the rounding to an established contour and burnishing the tip sides to prepare the tip for play. A process is described for preparing flat and concave files to be used in the invention.

7 Claims, 3 Drawing Sheets

CUE TIP SHAPING TOOL AND FILE FABRICATION METHOD FOR USE THEREWITH

BACKGROUND OF THE INVENTION AND PRIOR ART

This invention relates to a tool for trimming, shaping and burnishing the tips of billiard and pool sticks.

The high interest which these games have held for the public over a period of many years has been in part the result of the precision shots which highly skilled play brings about. These, in turn, rely on accurately placed impacts of the cue stick on the cue ball. A properly shaped and chalked leather tip insures that the contact will occur at a desired point on the cue ball; frictional resistance of the leather on the highly polished ball surface is relied upon to prevent slippage. The leather tip also protects the ball from chipping and from nicks and assures that the end of the stick will not splinter during hard impacts. Various spins can be imparted to the cue ball by precisely placed, off-center impacts and high velocities can be reached without damaging the equipment.

Various tools have been devised for adding new cue tips and for trimming and shaping them. Mahoney in 1910(U.S. Pat. No. 955,819) developed an apparatus with crank-operated grinding and sanding arrangements with which a newly attached tip can be trimmed and shaped. A cue tip trimmer by Zownir(U.S. Pat. No. 4,620,370) resembles a pencil sharpener; a fixed blade is rotated around the end of the billiard stick. The leather cue tip is, however, softer than pencil wood and will deform on encountering the blade. By cocking the stick, Zownir can exert sufficient pressure against the leather to stiffen it and allow trimming with the undesirable side effect that the tip is left somewhat tapered.

A recent improvement by Willard(U.S. Pat. No. 4,594,782) teaches a small, simple tool which can be attached to a key chain and which contains a concave sanding surface with projections by means of which a new cue tip can be trimmed and shaped. The Willard device also contains a guage to judge when the tip is properly shaped or when a used tip needs reshaping.

A cue tipping machine by Calabrese (U.S. Pat. No. 4,987,931) has provision for removing old cement from the end of the billiard stick, flattening the end, positioning a new tip on the end after adhesive is applied and clamping the new tip rigidly until the adhesive is dry. Other features include trimming means for the sides of the tip and rounding means for the end. Although the Calabrese device can be used in all the steps of of cue tip preparation, its trimming feature does not accomodate a number of cue stick sizes; a single large opening is used for all sizes. Many cue sticks must therefore be cocked during the trimming stage.

An early device by Boyle (U.S. Pat. No. 89,624), on the other hand, recognized this difficulty of leather compression and used a stretched rubber ring to press four knives radially against the cue tip and thus bypassed the problem.

SUMMARY OF THE PRESENT INVENTION

The present invention overcomes a number of shortcomings of the prior art. It can be used to prepare the end of a billiard or pool stick by removing old adhesive and by filing the tip-receiving surface so that it is flat and perpendicular to the stroking direction of the stick. After the leather tip is glued on and allowed to dry, the excess leather is trimmed by positioning the cue end against an internal blade. The pressure exerted against the blade is controlled by a precision drive so that the effect of leather flexure is minimized. After trimming, the tip is rounded to a standard curvature. Its contour is checked by an internal guage and the rounding step repeated if necessary. The rounding feature of the invention makes use of a concave file which has advantages over the sandpaper or silicon carbide lined concave chambers used in prior art inasmuch as the file is much less subject to clogging and can be cleaned with a small brush. This file permits more uniform rounding of the tip from stick to stick and the imparting of a rough surface to the leather inorder to maintain a charge of chalk longer. The method for fabricating the file is part of the invention.

When the tip is accurately rounded, there is often a slight bulging at the line between the rounded and cylindrical parts of the stick. The end of the stick is then placed in a burnishing portion of the invention and rotated to remove the bulge.

DETAILED DESCRIPTION OF THE INVENTION

Figure 1:
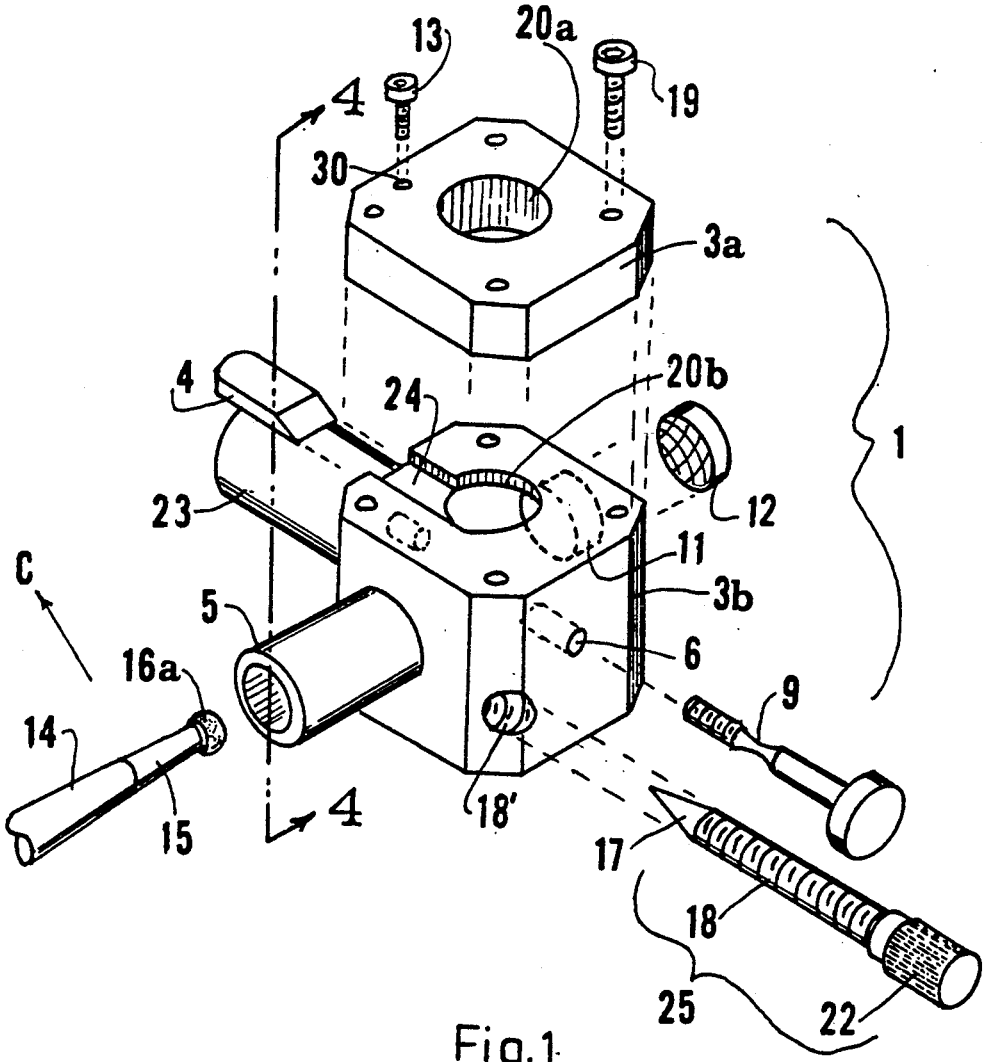
FIG. 1 is an exploded, isometric view of the invention.
Figure 2A:
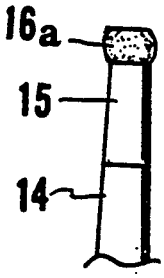
FIG. 2*a*–2*d* illustrate the process of trimming, rounding and burnishing a cue tip as it is carried out in the present invention.
Figure 2B:
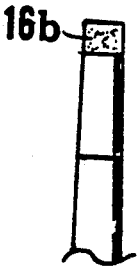
Figure 2C:
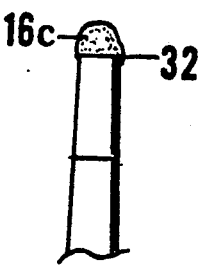
Figure 2D:
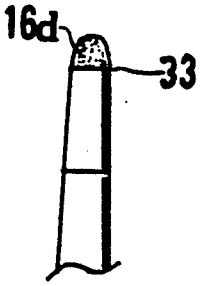

The invention, indicated in general by 1 in the exploded, isometric view of FIG. 1, is made up of a top plate 3*a* held to a bottom block 3*b* by the bolts 19 cooperating with holes in plate 3*a* and threaded holes in block 3*b*. Two walls of block 3*b* are perforated to hold tip inlet guides 5 and 23 as shown. A slot 24 accommodates a hardened steel blade 4 which can be fixed at any position along slot 24 by bolt 13 cooperating with threaded hole 30 when the plate and block are joined together. Relatively large holes 20*a* and 20*b* are drilled through the plate and the block to provide a viewing aperture when the invention is in use.

Figure 4:
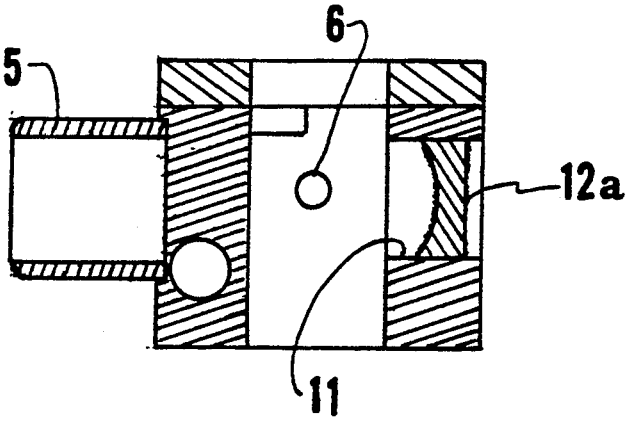
FIG. 4 is a cross section of the invention taken along X-X' of FIG. 1.

The vertical wall opposing inlet guide 5 is drilled out at 11 to accommodate the two sided file 12. Side 12*a* is flat and used to clean the face of ferrule 15 of the cue stick 14 prior to gluing on the leather tip 16*a*. Side 12*b* is a concave file used to shape and curve the tip after the adhesive has dried and the tip trimmed to cylindrical shape. The concave file leaves the surface of the leather rough so it will hold a charge of chalk. The file 12 is press fitted into hole 11 as illustrated in FIGS. 1 and 4. The construction of the curved inside surface of file 12 will be described below.

Figure 3:
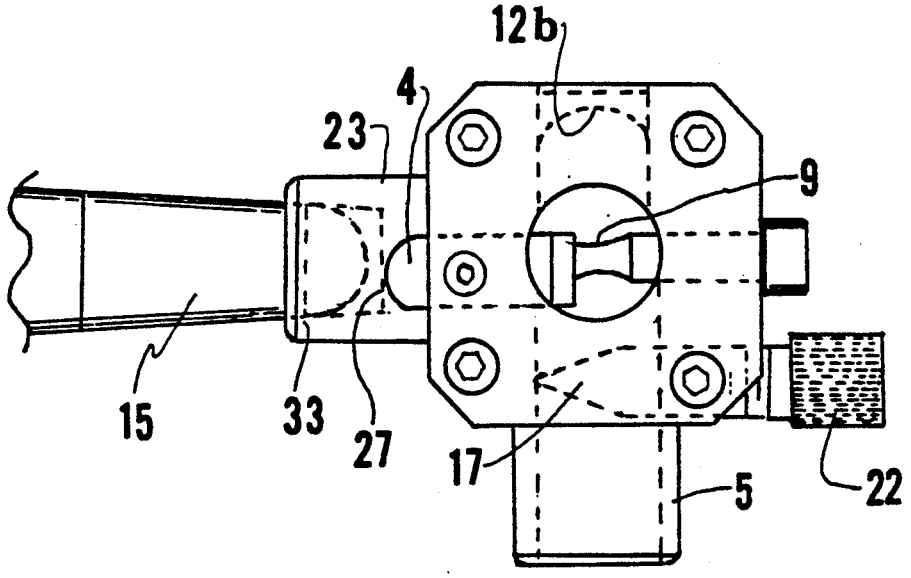
FIG. 3 is a side elevation of the invention with cue tips in the trimming and burnishing stages.

One vertical wall of block 3*b* is drilled at 6 and 18' to accept the template 9 and the positioner 25. The latter is made up of the cone 17, threaded section 18 and the turning knob 22. When positioner 25 is in place, cone 17 contacts cue stick ferrule 15 while the threaded section 18 engages threads in hole 18' as shown in FIG. 3. Turning of knob 22 forces cue stick ferrule 15' in the direction C so that the cue tip contacts the blade 4. Rotating the ferrule 15 now trims the tip from its original shape **16*a* to match the diameter of the ferrule as shown at 16*b* in FIG. 2. The leather's flexibility is thus overcome without the need for cocking the cue stick as with the prior art. The amount of force exerted against the blade 4 can thus be precisely controlled by postioner 25**.

When the cue tip has been trimmed, it is then placed in the concave file **12*b* where it is rotated and given the shape 16*c* shown in FIG. 2. When the tip is near a suitable curvature, its shape may be checked by installing template 9 and reinserting the cue tip in guide 5. During this operation some bulging or increasing of the diameter of the tip, shown by 32 in FIG. 2, may occur. The end of the cue stick is next placed in the tip inlet guide 23. The inner wall of 23 is finished in a smooth taper of its diameter such that the cue tip side contacts the wall without the end touching the bottom surface 27 (FIG. 3). Rotating cue stick 14 now reduces the bulging and burnishes the sides of the tip for its final, ready-for-play shape 16*d* as shown in FIG. 2**.

Figure 5:
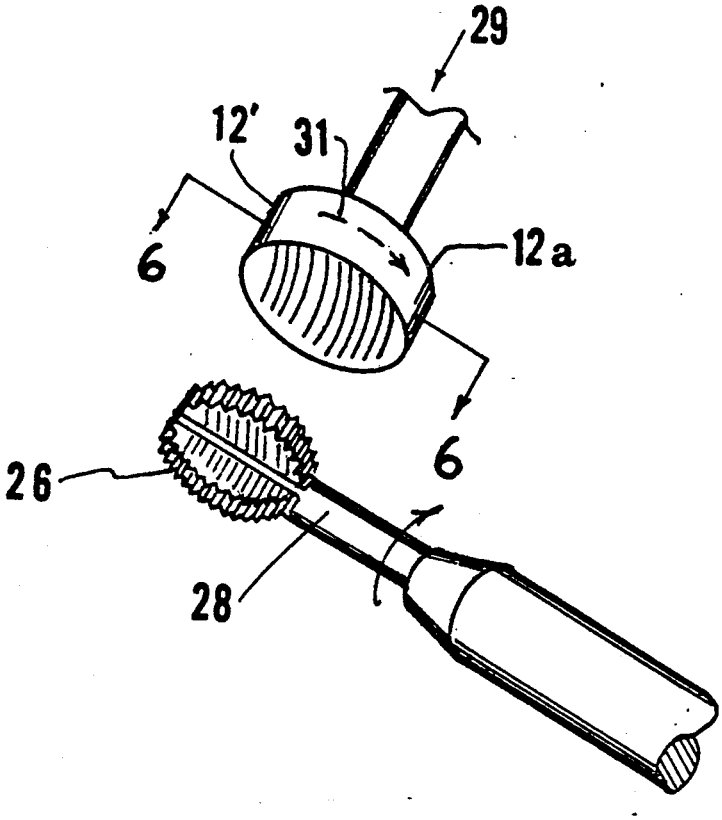
FIG. 5 is an isometric view of a special cutter used in producing the concave file which is a feature of the invention.
Figure 6:
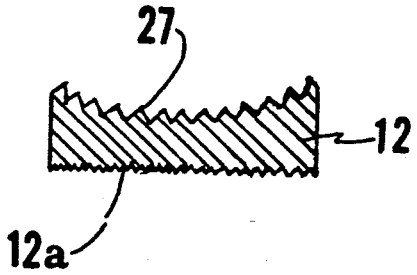
FIG. 6 is a cross section of the concave file taken across Y-Y' of FIG. 5.

File 12 is specially constructed for this use. Its fabrication is shown in FIG. 5. A multi-lobed cutting tool 28 contains hardened teeth 26 which are ground on the edges of each lobe. As tool 28 rotates, file blank 12' is fed in direction 29 perpendicular to the cutting teeth. This forms triangular grooves 26' in the blank, the concave shape being generated as a result of the shape of the cutting tool. After each cut, blank 12' is backed off, rotated by 60 degrees in direction 31 and then fed forward again (direction 29) for a new cut. The result is a series of triangular pyramids as shown in FIGS. 6 and 7 spaced evenly along the concave surface of blank 12'. A similar cutting tool which has teeth cut into a cylindrical surface is used to form pyramids on the plane surface **12*a* of the file blank. The double sided file thus formed is heat treated to harden the filing surfaces. The pyramids 27** provide cutting edges to remove old adhesive from the ferrule and later to shape the cue tip as described above. The spacing of the pyramids is such as to leave the abraded surface rough which facilitates the subsequent retention of adhesive and billiards chalk. The spacing also allows filings to be easily removed by means of a small brush so that the filing efficiency is uniform over a long period. This is in contrast to the sandpaper or garnet covered shaping units of the prior art which fill up easily and are subject to rapidly decreasing efficiency and short service life.

I claim:

1. A tip shaping tool for use in the processing of leather tipped ferrule ends of billiard and pool cue sticks comprised in combination of:

a. a two part block assembly with perforations in its faces to permit the inserting of and operations on cue stick ends;

b. a relatively large opening through the said two part block assembly for observation of the operations;

c. trimming means which can be reached through one of the perforations and used for reducing the diameter of a newly cemented leather tip;

d. forcing means by which the sides of the leather tip can be impressed against the trimming means to promote accurate trimming;

e. flat filing means for cleaning and flattening said ferrule end prior to the application of a tip;

f. concave filing means for shaping a trimmed leather tip into a hemispherical form;

g. gauging means for determining the degree of completion of a tip shaping operation;

h. burnishing means for smoothing and polishing the interface between a ferrule and a newly-prepared tip.

2. A tip shaping tool as described in claim 1 in which said trimming means is a knife blade adjustably fixed between the parts of said two part block assembly so as to project into one of the perforations and come into contact with the outer diameter of a cemented-on, leather cue tip.

3. A tip shaping tool as described in claim 1 in which said forcing means is a screw driven cone which enters the perforation in which the cue stick is being held and can be used, by advancement of the screw, to controllably move against the ferrule and thus advance the leather tip radially against the knife blade, this advancement plus turning of the ferrule serving to trim the leather tip to a desired diameter.

4. A tip shaping tool as described in claim 1 in which said flat filing means is a prepared plane surface which contains small, sharp cornered pyramids said surface positioned in another perforation of the block assembly whereby a tipless ferrule can be rotated against the prepared plane surface to clean it and to grind it flat.

5. A tip shaping tool as described in claim 1 in which said concave filing means is a prepared, internally curved surface cut into the opposite face of the flat filing means and also containing small, sharp cornered pyramids whereby a leather tip can be filed into a hemisherical shape by inserting the tip into the internally curved surface and rotating it.

6. A tip shaping tool as described in claim 1 in which said gauging means is a necked-in cylinder which can be positioned across the relatively large opening through the block, the filed leather-tip end of the cue stick inserted into one of the perforations so as to make contact with said necked-in cylinder and the degree of completion of the filing estimated.

7. A cue tip shaping tool as described in claim 1 in which said burnishing means is a hollow cylinder having a tapering smooth bore mounted in one of the faces of the block assembly, the said bore being of a diameter comparable to that of standard leather tipped ferrules whereby a semi-finished cue tip can be inserted into the bore and the cue stick rotated until any bulges in the leather tip are smoothed to a close fit with the ferrule.

* * * * *